US008748008B2

(12) United States Patent
Chun et al.

(10) Patent No.: US 8,748,008 B2
(45) **Date of Patent: *Jun. 10, 2014**

(54) HIGH PERFORMANCE COATINGS AND SURFACES TO MITIGATE CORROSION AND FOULING IN FIRED HEATER TUBES

(75) Inventors: ChangMin Chun, BelleMead, NJ (US); Narasimha-Rao Venkata Bangaru, Pittstown, NJ (US); Mark A Greaney, Upper Black Eddy, PA (US); Ian A Cody, Adelaide (AU); F. Pierce Hubbard, Jr., Fairfax, VA (US); David Samuel Deutsch, Flemington, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1082 days.

This patent is subject to a terminal disclaimer.

(21) Appl. No.: 12/480,067

(22) Filed: Jun. 8, 2009

(65) Prior Publication Data

US 2010/0015564 A1 Jan. 21, 2010

Related U.S. Application Data

(60) Provisional application No. 61/129,224, filed on Jun. 12, 2008.

(51) Int. Cl.

| | |
|---|---|
| ***B32B 15/01*** | (2006.01) |
| ***B32B 15/04*** | (2006.01) |
| ***B32B 15/18*** | (2006.01) |
| ***B32B 15/20*** | (2006.01) |
| ***C23C 28/00*** | (2006.01) |
| ***C23C 30/00*** | (2006.01) |
| *F28F 1/00* | (2006.01) |
| *F28F 13/14* | (2006.01) |
| *C07F 15/00* | (2006.01) |
| *F16L 9/14* | (2006.01) |

(52) U.S. Cl.

USPC ..... 428/632; 428/613; 428/629; 428/633; 428/639; 428/687; 428/34.1; 428/335; 428/336; 428/679; 428/680

(58) Field of Classification Search

USPC ..... 428/613, 629, 632, 633, 639, 650, 651, 428/652, 653, 654, 213, 215, 666, 667, 684, 428/685, 687, 34.1, 332, 335, 336, 220, 428/679, 680

See application file for complete search history.

(56) References Cited

U.S. PATENT DOCUMENTS

| | | | | |
|---|---|---|---|---|
| 6,165,286 | A * | 12/2000 | Bayer et al. | 148/220 |
| 2007/0187078 | A1 | 8/2007 | Greaney | |

(Continued)

FOREIGN PATENT DOCUMENTS

| | | | |
|---|---|---|---|
| JP | 2003535976 | A | 12/2003 |
| WO | 0194664 | A2 | 12/2001 |
| WO | W02008010965 | A1 | 1/2008 |

OTHER PUBLICATIONS

International Search Report, PCT/US2009/046715, mailed Aug. 3, 2009.

(Continued)

*Primary Examiner* — Michael E La Villa

(74) *Attorney, Agent, or Firm* — Glenn T. Barrett

(57) ABSTRACT

A fired heater tube that is resistant to corrosion and fouling is disclosed. The fired heater tube comprises an advantageous high performance coated material composition resistant to corrosion and fouling comprises: (PQR), wherein P is an oxide layer at the surface of (PQR), Q is a coating metal layer interposed between P and R, and R is a base metal layer, wherein P is substantially comprised of alumina, chromia, silica, mullite, spinels, and mixtures thereof, Q comprises Cr, and at least one element selected from the group consisting of Ni, Al, Si, Mn, Fe, Co, B, C, N, P, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag, Au and mixtures thereof, and R is selected from the group consisting of low chromium steels, ferritic stainless steels, austenetic stainless steels, duplex stainless steels, Inconel alloys, Incoloy alloys, Fe—Ni based alloys, Ni-based alloys and Co-based alloys.

6 Claims, 3 Drawing Sheets

(56) References Cited

U.S. PATENT DOCUMENTS

| | | | | |
|---|---|---|---|---|
| 2008/0020216 | A1 | 1/2008 | Bagnoli et al. | |
| 2012/0097581 | A1* | 4/2012 | Chun et al. | 208/48 R |
| 2012/0211400 | A1* | 8/2012 | Chun et al. | 208/47 |

OTHER PUBLICATIONS

Written Opinion, PCT/US2009/046715, mailed Aug. 3, 2009.
Written Opinion, Singapore Patent Application No. 201008012-5, mailed Mar. 15, 2012.

* cited by examiner

HIGH PERFORMANCE COATINGS AND SURFACES TO MITIGATE CORROSION AND FOULING IN FIRED HEATER TUBES

CROSS REFERENCE TO RELATED APPLICATION

This application relates to and claims priority to U.S. Provisional Patent Application No. 61/129,224, filed on Jun. 12, 2008.

FIELD OF THE INVENTION

This invention relates to the reduction of carburization and sulfidation corrosion and the reduction of depositional fouling in general and in particular the reduction of carburization and sulifidation corrosion and the reduction of depositional fouling in fired heater tubes in refinery process units, petrochemical processing facilities, and in other ancillary and related industries such as synthetic fuels processes, (e.g., coal to liquids, coal gasification and gas to liquids) and other components used for transporting or conveying process streams, which may be prone to corrosion and fouling. The present invention also relates to the reduction of corrosion and fouling associated with process streams, which include but are not limited to heavy crude oils and resid streams. More specifically, the present invention is directed to a high performance coated material for use in the reduction of corrosion and fouling in fired heater tubes in refinery process units and a method of making the same.

BACKGROUND OF THE INVENTION

In typical refinery processes, stored heavy crude oil is cleaned of contaminants (e.g., sand, salts and water) as the first step in the refining process by passage through desalting units. The clean crude feedstock is then heated by passing the desalted crude through a series of heat exchangers. The crude is then passed through a furnace that heats the crude oil to a higher temperature. The furnace, which may be a oil, natural or refinery fuel gas-fired furnace or electrically fired furnaces, heats the oil and is injected into an atmospheric distillation tower. The extreme heat produces physical splitting of the crude oil into combustion gas (furnace fuel gas) and other gaseous light ends, liquid products, and an atmospheric resid fraction.

A large amount of heavy resid content is characteristic of heavy oils. The atmospheric resid must be subjected to more refining. Following the atmospheric tower, the resid is further heated in another series of heat exchangers and then another furnace and sent to a vacuum distillation tower, where light vacuum gas oil and heavy vacuum gas oil are extracted from the resid. The remaining tarry fluid left near the base of the vacuum tower, the vacuum residue, can either be (i) claimed as asphalt, or (ii) subject to further processing, such as coking. In various coking processes, the resid is heated to high temperatures of 850-950° F. (454-510° C.) such that the light boiling products are thermally cracked off of the aromatic cores in the resid and are distilled overhead and the solid coke remains.

The delayed coking process is one of the most widely commercially practiced of the coking processes. The resid is heated to the coking temperature by flowing through a long tube in a furnace and then allowed to react at this elevated temperature after flowing into the bottom of a high cylindrical insulated drum. The volatile products are removed to a fractionator and coke accumulates in the drum. The heavy liquid product from the fractionator is recycled back to the furnace. When the drum fills up with coke, the feed is switched to a second drum. The coke is mined out of the drum by drilling a hole down the center with high pressure water and cutting out the remainder also with high-pressure water to get the drum ready for the next coke accumulation cycle.

In Fluid Coking™, the resid is sprayed onto a hot, fluidized bed of coke particles in a vessel (i.e., the reactor). The volatile products are removed to a fractionator while the coke particles are removed from the bottom of the vessel and transferred to another vessel (i.e., the burner), where the coke is partially burned with air to provide heat for the process. The coke then is recirculated back to the reactor. Since this process produces much more coke than is required for heating the process, fluid coke is withdrawn at the bottom of the reactor.

In FLEXICOKING™, a third vessel (i.e., the gasifier), is added to the Fluid Coking process. In the gasifier, coke is gasified with steam and air in net reducing conditions to produce a low BTU gas containing hydrogen, carbon monoxide, nitrogen, and hydrogen sulfide. The hydrogen sulfide is removed using adsorption. The remaining low BTU gas is burned as a clean fuel within the refinery and/or in a nearby power plant.

Visbreaking is a low conversion thermal process used originally to reduce the resid viscosity for heavy fuel oil applications. Today, it often uses a resid that exceeds minimum heavy fuel oil specifications and converts just enough to obtain 15-30% transportation boiling range liquids and still have the heavy product meet heavy fuel oil specifications. Since this process cannot tolerate coke formation, it is required to be within the coke induction period that may limit conversion, rather than heavy fuel oil specifications. A visbreaker reactor may be similar to a delayed coker with a furnace tube followed by a soaker drum. However, the drum is much smaller in volume to limit the residence time with the entire liquid product flowing therethrough. Alternatively, the entire visbreaker may be a long tube coiled within a furnace. Upsets cause coke to form and accumulate on visbreaker walls, which requires periodic decoking.

The coker tube furnace is the heart of the delayed coking process. The heater furnishes all of the heat in the process. Typically, there are two to four passes per furnace. The tubes are mounted horizontally on the side and held in place with alloy hangers. Multiple burners are along the bottom of the radiant wall opposite from the tubes and are fired vertically upward. Tall furnaces are advantageous since the roof tubes are less likely to have flame impingement and overheating by both radiation and convection. Normally just the radiant section of the heater is used to heat the oil for a delayed coker. The upper convection section of the coker heater is used in some refineries to preheat the oil going to the fractionator or for other uses (e.g., steam generation).

The radiant section tubes in a fired heater used in many refinery process units can experience fouling on the inside and/or outside of the tube surface. External tube fouling occurs when the heater is oil fired. During oil combustion solid particulate matter is formed containing carbon, sulfur and metals which are present in fuel oil. This particulate matter will over time collect on external tube surfaces. Fired heaters that heat crude and reduced crude usually experience the highest level of internal fouling. With these fluids, the fouling occurs due to (i) the presence of solids in the fluid, (ii) thermal cracking forming high molecular weight compounds and (iii) in situ corrosion products. All these materials can end up sticking to the tube wall and forming "coke". Liquids lighter than crude can also form internal deposits. For example, fired heaters heating liquid naphtha can experience internal tube fouling due to corrosion products and/or polymerization reactions forming long chain molecules which stick to the tube wall. Internal tube fouling usually has a large impact on heater operation and thermal efficiency.

These formations/foulant/coke deposits can result in an increase in the radiant tube metal temperature (TMT). As coke forms inside the heater tube, an insulation barrier between the metal and the "colder" process fluid is formed, resulting in an increased TMT. If coking is allowed to occur without intervention, a tube rupture as a result of high TMT (due to lessened metal strength) is possible. To avoid this, heaters with internal coke deposits can be operated at reduced rates (and hence reduced efficiency and productivity) such that metallurgical constrains are not exceeded on the tubes and tube rupture is avoided. Heaters in fouling service are designed to accommodate a specified TMT increase above the clean tube condition. When that limit is reached steps must be taken to remove the foulant. Often this means the heater must be shut down for cleaning. A secondary effect of internal fouling is increased pressure drop, which limits capacity and throughput. Heaters in fouling service are also designed to accommodate a specified increase in pressure drop. In most cases, the TMT limit is reached before the pressure drop limit. When coke forms in the heater tubes, it insulates the inside of the tube which results in elevated temperatures on the outside of the tube. With good operational practices, coker furnace can be operational for 18 months before decoking of the tubes is needed. Depending on the tube metallurgy, when temperatures approach 1250° F. (677° C.) on the exterior skin thermocouple, the furnace must be steam spalled and/or steam-air decoked or cooled down and cleaned by hydraulic or mechanical pigging.

During normal use, the internal surfaces of the fired heater tubes are subject to carburization sulfidation, naphthenic acid corrosion and other forms of high temperature corrosion as a result of the prolonged exposure to the stream of heavy crude oil, resid and other petroleum fractions. Carburization is a form of high temperature degradation, which occurs when carbon from the environment diffuses into the metal, usually forming carbides in the matrix and along grain boundaries at temperatures generally in excess of 1000° F. (538° C.). Carburized material suffers an increase in hardness and often a substantial reduction in toughness, becoming embrittled to the point of exhibiting internal creep damage due to the increased volume of the carbides. Crude oils and hydrocarbon fractions which contain reactive sulfur are corrosive to carbon and low/medium alloy steels at temperatures above 500° F. (260° C.) and will cause sulfidation corrosion which forms iron sulfide. This sulfide scale that is formed is often referred to as sulfide induced fouling. Those which contain naphthenic acidic components are corrosive to carbon and low/medium alloy steels at temperatures above 400° F. (204° C.) and directly remove metal from the surface of the fired heater tube. Corrosion on the internal surfaces of the fired heater tubes creates an uneven surface that can enhance fouling because the various particles found in the petroleum stream may attach themselves to the roughened surface. It is also suggested that corroded surfaces may also provide a "more hospitable" surface for foulant lay down.

Synthetic crudes are derived from processing of bitumens, shale, tar sands or extra heavy oils and are also processed in refinery operations. These synthetic crudes present additional fouling problems, as these feedstocks are too heavy and contaminant laden for the typical refinery to process. The materials are often pre-treated at the production site and then shipped to refineries as synthetic crudes. These crudes may contain fine particulate silicaceous inorganic matter, such as in the case of tar sands. Some may also contain reactive olefinic materials that are prone to forming polymeric foulant deposits within the fired heater tubes.

Currently, there are various surface modification techniques available for reducing corrosion and fouling in the fired heater tubes for refinery operations. Most of them are based on thin film coatings and include alonizing, hexamethyldisilazane (HMDS) and liquid phase silicate coatings. Alonizing is a diffusion alloying method and applied to the metal surface at elevated temperatures. As a result, about 100μ thick, aluminum enriched layer forms on the metal surface. However, this coating, as characteristic of all such relatively thin coatings, reveals poor mechanical integrity and thermal stability due to presence of voids, defects and intermetallic brittle phases in the layer and has low reliability.

Therefore, there is a need to significantly reduce corrosion and fouling in the fired heater tubes in refinery and petrochemical processing operations that does not encounter the drawbacks associated with the current techniques. The present invention provides a new way to achieve stable, durable surfaces to resist high temperature corrosion and fouling in fired heater tubes, in refinery process units, petrochemical processing facilities and other components used for transporting or conveying process streams, which may be prone to fouling.

SUMMARY OF THE INVENTION

It is an aspect of the present invention to provide a fired heater tube that is resistant to corrosion and fouling. The fired heater tube is used to raise the temperature of a process fluid or stream (e.g., a crude oil based stream to be processed in a refinery or petrochemical facility). The fired heater tube may be a radiant section tube of the furnace. The present invention is not intended to be limited to radiant section tubes; rather, the present invention has application within other fired heaters which are prone to corrosion and fouling when subject to heavy crude oils and resid streams. The crude oil is heated within the hollow interior of the radiation section tubes as the crude oil flows through the tubes. The fired heater may have convection and radiant sections and the radiant section includes a plurality of fired heater tubes.

In accordance with the present invention, each fired heater tube may be formed from a high performance coated material that is resistant to carburization, naphtanic acid corrosion, sulfidation, and other forms of high temperature corrosion and fouling. The use of a high performance coated material that is resistant to corrosion and fouling significantly mitigates carburization, naphtanic acid corrosion, sulfidation and other forms of high temperature corrosion and suppresses fouling, which produces numerous benefits including (i) an increase in heating efficiency, (ii) a reduction in the overall amount of energy needed to heat the crude oil, (iii) an increase in refinery throughput and (iv) a significant reduction in refinery downtime.

According to the present disclosure, an advantageous high performance coated material composition resistant to corrosion and fouling comprises: (PQR), wherein P is an oxide layer at the surface of (PQR), Q is a coating metal layer interposed between P and R, and R is a base metal layer, wherein P is a mono-layer or made up of multiple layers and substantially comprised of alumina, chromia, silica, mullite, spinels and mixtures thereof and may contain some impurity oxides formed from the element constituting a coating metal Q, and a base metal R, Q comprises Cr, and at least one element selected from the group consisting of Ni, Al, Si, Mn, Fe, Co, B, C, N, P, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag, Au and mixtures thereof, and R is selected from the group consisting of low chromium steels, ferritic stainless steels, austenetic stainless steels, duplex stainless steels, Inconel alloys, Incoloy alloys, Fe—Ni based alloys, Ni-based alloys and Co-based alloys.

It is an aspect of the present invention to provide a high performance coated material composition that is resistant to corrosion and fouling for use in refinery and petrochemical processing application. The composition includes a base metal layer, a coating metal layer and an oxide layer. The base metal layer is selected from the group consisting of low chromium steels, ferritic stainless steels, austenetic stainless steels, duplex stainless steels, Inconel alloys, Incoloy alloys, Fe—Ni based alloys, Ni-based alloys and Co-based alloys. Preferably, the base metal is one of a T9 low chromium steel or a 347 austenetic stainless steel. The coating metal layer is located on at least one side of the base metal layer. It is contemplated that in a fired heater tube having an interior surface and an exterior surface that the coating metal layer be located on at least one of the interior surface and exterior surface. The coating metal layer is comprised of Cr, and at least one element selected from the group consisting of Ni, Al, Si, Mn, Fe, Co, B, C, N, P, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag, Au and mixtures thereof. An oxide layer P is located on the coating metal layer Q. The oxide layer P is a mono-layer or made up of multiple layers and substantially comprised of alumina, chromia, silica, mullite, spinels and mixtures thereof and may contain some impurity oxides formed from the element constituting a coating metal, Q, and a base metal R. The oxide layer is preferably alumina.

BRIEF DESCRIPTION OF THE DRAWINGS

The invention will now be described in conjunction with the accompanying drawings in which like reference numerals describe like elements and wherein.

DETAILED DESCRIPTION OF PREFERRED EMBODIMENTS

The high performance coated material composition resistant to corrosion and fouling of the present invention is represented by the formula (PQR). P is an oxide layer at the surface of (PQR) and is a mono-layer or made up of multiple layers and substantially comprised of alumina, chromia, silica, mullite, spinels and mixtures thereof and may contain some impurity oxides formed from the element constituting a coating metal Q and a base metal R. The oxide layer P forms the outer surface layer of the high performance coated material composition (PQR), and therefore the layer that is directly in contact with heavy crude oils and resid streams in refinery process units. Located adjacent to the oxide layer P is a coating metal Q comprising Cr, and at least one element selected from the group consisting of Ni, Al, Si, Mn, Fe, Co, B, C, N, P, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag, Au, and mixtures thereof. Located on the opposite side of the coating metal layer Q is a base metal R selected from the group consisting of low chromium steels, ferritic stainless steels, austenetic stainless steels, duplex stainless steels, Inconel alloys, Incoloy alloys, Fe—Ni based alloys, Ni-based alloys and Co-based alloys.

Figure 1:
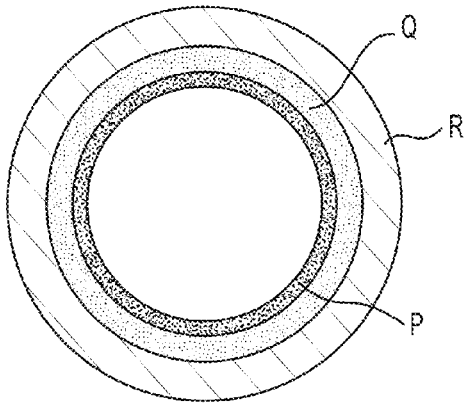
FIG. 1 is an end view of a fired heater tube having a high performance coated material of the present invention.
Figure 2:
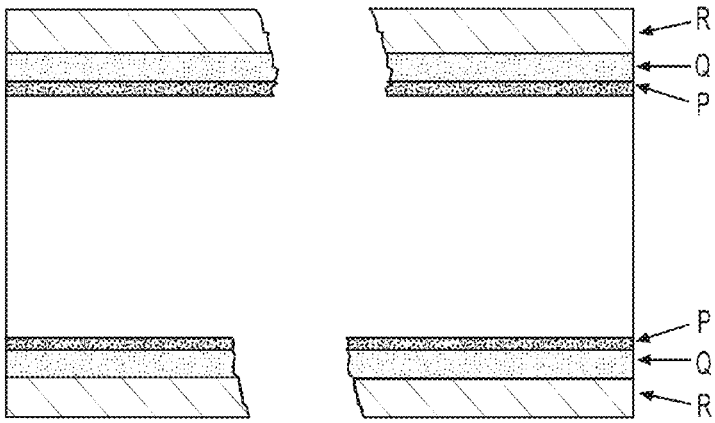
FIG. 2 is a side cross sectional view of the fired heater tube having a high performance coated material in accordance with the present invention.

The high performance coated material compositions (PQR) of the present invention described herein may be utilized to construct the surface of fired heater tubes in refinery process units. FIGS. 1 and 2 schematically illustrate the use of the coated material (PQR) for fired heater tubes in refinery process units. As a non-limiting example, the fired heater tubes in refinery process units may be coated on inside diameter. Surfaces of the fired heater tubes which would benefit from the high performance coated material of the instant invention include apparatus, reactor systems and units that are in contact with heavy crude oils and resid streams at any time during use. These apparatus, reactor systems and units include, but are not limited to, atmospheric and vacuum distillation pipestills, cokers and visbreakers in refinery processing facilities and other components used for transporting or conveying process streams, which may be prone to corrosion and fouling.

The oxide layer P on the surface of the coating metal Q forms in-situ during use of the coated material when exposed to heavy crude oils and resid streams in refinery process units. Alternatively, an oxide layer P on the surface of a coating metal Q forms prior to use by exposing the coated material to controlled low oxygen partial pressure environments.

The oxide layer P is a mono-layer or made up of multiple layers and comprised of alumina, chromia, silica, mullite, spinels and mixtures thereof and may contain some impurity oxides formed from the element constituting a coating metal Q and a base metal R. A preferred oxide layer P is substantially alumina. The alumina layer preferably forms from the coating metal Q containing at least 3 wt. % Al and 15 wt. % Cr based on the total weight of the coating metal Q. The thickness of an oxide layer P ranges from at least about 1 nm to about 100μ, preferably from at least about 10 nm to about 50μ, more preferably from at least about 100 nm to about 10μ.

The oxide layer P on the surface of the coating metal Q described herein may also be formed on the coating metal surface by exposing the coated material to controlled low oxygen partial pressure environments. The controlled low oxygen partial pressure environments are gaseous environments having thermodynamic oxygen partial pressures less than that of air. Non-limiting examples of a controlled low oxygen partial pressure environment is a refinery steam, gaseous $H_2O$:$H_2$ mixture and a gaseous $CO_2$:CO mixture. The controlled low oxygen partial pressure environment may further contain other gases such as $CH_4$, $NH_3$, $N_2$, $O_2$, He, Ar and hydrocarbons and enable formation of a stable oxide layer P comprising alumina, chromia, silica, mullite, spinels, and mixtures thereof on the coating metal Q. Therefore, the protective oxide layer is formed prior to exposure of the high performance coated material to heavy crude oils and resid streams in refinery process units. The preferred temperature range of the controlled low oxygen partial pressure environment is from about 300° C. to about 1000° C., preferably from about 400° C. to about 1000° C. Typical exposure times range from about 1 hour to about 500 hours, preferably from about 1 hour to about 300 hours, and more preferably from about 1 hour to about 100 hours.

The coating metal Q includes a mixture Cr, and at least one element selected from the group consisting of Ni, Al, Si, Mn, Fe, Co, B, C, N, P, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag, Au, and mixtures thereof. The coating metal compositions of the present invention offer significant advantages relative to prior art alloy compositions for use as protective coatings to corrosion and fouling of fired heater tubes when exposed to crude oils and resid streams in refinery process units. As a non-limiting example, alloying elements such as Al, Si, Sc, La, Y and Ce, provide improved adhesion of in-situ formed surface oxide films, which contributes to enhanced spalling resistance. These elements can be present in the coating metal as a form of oxide particles. Non-limiting examples are $Y_2O_3$ and $CeO_2$. The coating metal Q containing oxide particles are known as oxide dispersion strengthened (ODS) alloys. Alloying elements such as Ga, Ge, As, In, Sn, Sb, Pb, Pd, Pt, Cu, Ag and Au, provide reduced fouling because these elements are non-catalytic to surface carbon transfer reaction. Alloying elements such as Re, Ru, Rh, Ir, Pd, Pt, Cu, Ag and Au provide increased coating integrity, stability and durability and provide a defect-free alumina layer when it preferably forms from the coating metal Q containing at least 3 wt. % Al and 15 wt. % Cr based on the total weight of the coating metal Q.

It is preferred that the coating metal layer Q is based on nickel and comprises about 5 wt. % to about 50 wt. % iron and more preferably about 5 wt % to about 40 wt % iron. Presence of iron in the coating metal layer Q provides a better thermal and mechanical compatibility to the base metal layer R. It is also preferred that the coating metal layer Q comprises less than about 0.1 wt. % carbon, preferably less than about 0.08 wt. % carbon, and more preferably less than about 0.05 wt. % carbon. Presence of carbon in the coating metal layer Q provides a better coating compatibility to the base metal layer R. Carbon can be present in the coating metal layer as a form of carbide precipitates, which provide creep strength of the relatively thick coating to the substrate when it is exposed to high temperatures for extended period of time. The coating metal layer Q comprises about 3 wt. % to about 20 wt. % aluminum, preferably about 3 wt. % to about 15 wt. % aluminum, and more preferably about 3 wt. % to about 10 wt. % aluminum. The coating metal layer Q further comprises about 15 wt. % to about 50 wt. % chromium, preferably about 15 wt % to about 45 wt %, more preferably about 15 wt. % to about 35 wt. % chromium, and more preferably about 15 wt. % to about 25 wt. % chromium. In one embodiment of the present invention, the chromium content is between 20 and 22.5 wt %. In one embodiment of the present invention, the coating metal layer Q is comprised of about 59 wt. % nickel, 10 wt. % iron, about 6 wt. % aluminum, and about 25 wt. % chromium. In another embodiment, the coating metal layer Q is comprised of about 35 wt. % nickel, 35 wt. % iron, about 5 wt. % aluminum, and about 25 wt. % chromium. The coating metal layer Q may further comprise about 0.01 wt. % to about 2.0 wt. % of at least one element selected from Sc, La, Y and Ce. In yet another embodiment, the coating metal layer Q is comprised of about 58.5 wt. % nickel, 10 wt. % iron, about 6 wt. % aluminum, about 25 wt. % chromium, and about 0.5 wt. % yttrium. In still another embodiment, the coating metal layer Q is comprised of about 35 wt. % nickel, 34.5 wt. % iron, about 5 wt. % aluminum, about 25 wt. % chromium, and about 0.5 wt. % yttrium. The coating metal layer Q may further comprise about 0.01 wt. % to about 2.0 wt. % of oxide particles of at least one element selected from Al, Si, Sc, La, Y and Ce. In yet another embodiment, the coating metal layer Q is comprised of about 58.5 wt. % nickel, 10 wt. % iron, about 6 wt. % aluminum, about 25 wt. % chromium, and about 0.5 wt. % $Y_2O_3$. In still another embodiment, the coating metal layer Q is comprised of about 35 wt. % nickel, 34.5 wt. % iron, about 5 wt. % aluminum, about 25 wt. % chromium, and about 0.5 wt. % $Y_2O_3$. The coating metal layer Q may further comprise about 0.01 wt. % to about 4.0 wt. % of at least one element selected from Mn, Ti, Zr, Hf, V, Nb, Ta, Mo and W. It is also preferred that the coating metal layer Q comprises less than about 0.8 wt. % silicon, preferably less than about 0.6 wt. % silicon, and more preferably less than about 0.4 wt. % silicon. Excessive amounts of silicon (e.g., greater than about 0.8 wt. % silicon) in the coating metal layer Q promotes solidification-induced cracking. In one embodiment, the silicon content is preferably approximately about 0.3 wt % of silicon. The coating metal layer Q may further comprise about 0.01 wt. % to about 2.0 wt. % of at least one element selected from Ga, Ge, As, In, Sn, Sb, Pb, Pd, Pt, Cu, Ag and Au. The coating metal layer Q may further comprise about 0.01 wt. % to about 2.0 wt. % of at least one element selected from Re, Ru, Rh, Ir, Pd, Pt, Cu, Ag and Au. In still another embodiment, the coating metal layer Q is comprised of about 44.6 wt % Cr, about 8.9 wt % Fe, about 0.3 wt % Si with balance being Ni. In still another embodiment, the coating metal layer Q is comprised of about 19.9 wt % Cr, about 5.2 wt % Al, about 38.6 wt % Fe, about 0.3 wt % Si with the balance being Ni. In still yet another embodiment, the coating metal layer Q is comprised of about 21.6 wt % Cr, about 5.5 wt % Al, about 34.9 wt % Fe, about 0.3 wt % Si with the balance being Ni.

The coating metal of the present invention has a low porosity which contributes to its improved resistance to corrosion and fouling when exposed to crude oils and resid streams in refinery process units. The coating metal layer Q has less than about 3 vol. % porosity, preferably less than about 2 vol. % porosity, more preferably less than about 1 vol. % porosity, and even more preferably less than 0.5 vol. % porosity. Excessive porosity in the coating metal layer serves as a pathway for gaseous molecules of heavy crude oils and resid streams in refinery process units to transfer gaseous molecules to the coating metal and to the base metal surface. The transfer of gaseous molecules triggers corrosion in the coating metal layer and delamination of the coating metal at the coating/base metal interface. Thus, it is advantageous to achieve a coating metal layer containing a minimal amount of porosity.

The low porosity coating metal layer can be established by a coating method such as Chemical Vapor Deposition (CVD), Metallo-Organic Chemical Vapor Deposition (MOCVD), Physical Vapor Deposition (PVD), slurry coating, pack cementation, weld overlay, direct metal laser deposition (DMLD) and plasma powder welding (PPW). The coating metal layer may be post-annealed or laser melted to achieve a higher density coating. In contrast, the conventional thermal spray coating processes such as atmospheric plasma spray generally yield the coating metal layer that is of a higher porosity and/or inclusions that damage its mechanical integrity and durability. The conventional thermal spray coating is produced by a process in which molten or softened particles are applied by impact onto a substrate. The coating often contains lenticular or lamellar grain structure resulting from the rapid solidification of small globules, flattened from striking a cold surface at high velocities. It is virtually impossible to ensure that all particles are the exact same size and achieve the same temperature and velocity. Thus, variations in the conditions of the individual particles on impact during thermal spray process lead to heterogeneous structure of the coating layer, which includes excessive porosity.

A preferred coating method is PPW. It is a weld-overlay technique using the powder welding process with plasma arc and can be used for inside tube coatings wherein the inner diameter of the tube is greater than 1.65". The welding material, in powder form, is introduced into a transferred plasma arc generated between the base metal and a tungsten electrode, and is deposited as a coating metal layer on the surface of the base metal. Some advantages of PPW coating method include high bonding strength, fine microstructure of the coating, low dilution of the coating metal with the substrate alloy (a base metal R) elements and negligible defects such as blow holes and oxide particles and other inclusions. The PPW coating method is also advantageous from the point of view of minimizing substrate alteration such as the minimal heat-affected-zone in the substrate.

A non-limiting list of coating metals Q for use in the present invention is presented in Table 1. These coating metals are suitable for making advantageous high performance coated materials (PQR) resistant to corrosion and fouling in fired heater tubes.

TABLE 1

| Coating Metal Q | Alloy Compositions (Weight %) |
|---|---|
| NiCr | Bal.Ni:50.0Cr |
| NiFeCr | Bal.Ni:44.6Cr:8.9Fe:0.3Si |
| NiCrMo | Bal.Ni:40.2Cr:1.0Mo:8.9Fe:0.4Mn:0.3Si:0.1Ti:0.02C |
| NiCrAl | Bal.Ni:25.0Cr:6.0Al |
| NiCrAlY | Bal.Ni:30.0Cr:10.0Al:1.0Y |
| NiFeCrAl | Bal.Ni:21.4Cr:5.6Al:12.9Fe:0.1Mn:0.6Si:0.1Ti:0.02C |
| NiFeCrAl-2 | Bal.Ni:25.0Cr:6.0Al:10.0Fe |
| NiFeCrAl-3 | Bal.Ni:25.0Cr:5.0Al:35.0Fe |
| NiFeCrAl-4 | Bal.Ni:19.9Cr:5.2Al:38.6Fe:0.3Si |
| NiFeCrAl-5 | Bal.Ni:21.6Cr:5.5Al:34.9Fe:0.3Si |
| NiFeCrAlY | Bal.Ni:25.0Cr:6.0Al:10.0Fe:0.5Y |
| NiFeCrAlY-2 | Bal.Ni:25.0Cr:5.0Al:35.0Fe:0.5Y |
| NiFeCrAl—$Y_2O_3$ | Bal.Ni:25.0Cr:6.0Al:10.0Fe:0.5$Y_2O_3$ |
| NiFeCrAl—$Y_2O_3$-2 | Bal.Ni:25.0Cr:6.0Al:35.0Fe:0.5$Y_2O_3$ |
| FeCrAl | Bal.Fe:20Cr:5.0Al |
| FeCrAlY | Bal.Fe:22Cr:5.5Al:0.5Y |
| PM2000 | Bal.Fe:19.0Cr:5.5Al:0.5Ti:0.5$Y_2O_3$ |
| MA956 | Bal.Fe:20Cr:5Al:0.5$Y_2O_3$ |
| Kanthal APM | Bal.Fe:22.0Cr:5.8Al:0.2Mn:0.4Si:0.05C |
| Kanthal APMT | Bal.Fe:21.0Cr:5.0Al:3.0Mo:0.7Si:0.08C |

The coating metal Q may be applied to a base metal R by weld overlay methods such as DMLD and PPW. The thickness of the coating metal ranges from about 0.1 mm to about 5 mm, preferably from about 0.5 mm to about 4 mm, more preferably from about 0.5 mm to about 3 mm, and even more preferably 0.5 mm to 1.5 mm. Alternatively the coating metal Q may be applied to a base metal R by co-extrusion method. Bimetallic co-extrusion is related to large plastic deformation of two different materials and can be done by optimizing several process parameters. Alternatively the coating metal Q may be applied to a base metal R by co-casting method. The co-casting enables formation of bimetallic tubular products having a coating metal layer Q and a base metal layer R by sequential solidification. As a non-limiting example, co-casting apparatus may have at least one cooled divider wall at the entry end portion of the mold to divide the entry end portion into at least two feed chambers. Metal is fed to the chambers to form an inner base metal layer and at least one outer coating metal layer.

In accordance with another aspect of the present invention, the interior surface of the wall of the fired heater tubes is formed to have an average surface roughness (Ra) of less than 40 micro inches (1.1 μm). Preferably, the surface roughness is less than 20 micro inches (0.5 μm). More preferably, the surface roughness is less than 10 micro inches (0.25 μm). It is contemplated that the inner surfaces of the plurality of the fired heater tubes may have the above-mentioned surface roughness. Such a surface roughness may further reduce fouling. The smooth surface within the inner diameter of the fired heater tubes reduces fouling of the heavy crude oil and resid stream flowing through the tubes. Roughness is routinely expressed as the arithmetic average roughness (Ra). The arithmetic average height of roughness component of irregularities from the mean line is measured within the sample length L. The standard cut-off is 0.8 mm with a measuring length of 4.8 mm. This measurement conforms to ANSI/ASME B46.1 "Surface Texture—Surface Roughness, Waviness and Lay," which was employed in determining the surface roughness in accordance with the present invention.

A non-limited means of reducing the surface roughness include mechanical polishing, electro polishing and lapping. There are additional benefits of reducing the surface roughness of the coated metal. One of the benefits is the shifting from a linear growth rate of the foulant, which results in the continuous thickening of the foulant deposit; to an asymptotic growth rate which reaches a finite thickness and then stops thickening.

The base metal R is selected from the group consisting of low chromium steels, ferritic stainless steels, austenetic stainless steels, duplex stainless steels, Inconel alloys, Incoloy alloys, Fe—Ni based alloys, Ni-based alloys and Co-based alloys. The base metal R may also be any commercially available alloy to be used for constructing fired heater tubes in refinery process units. A non-limiting list of base metals R for use in the present invention is presented in Table 2. These base metals are suitable for making advantageous high performance coated materials (PQR) resistant to corrosion and fouling in the fired heater tubes.

TABLE 2

| Base Metal R | Alloy | UNS No. | Alloy Compositions (Weight %) |
|---|---|---|---|
| Low chromium steels | T11 | K11562 | Bal.Fe:1.25Cr:0.5Mo, 0.5Si, 0.3Mn, 0.15C, 0.045P, 0.045S |
| | T22 | K21590 | Bal.Fe:2.25Cr:1.0Mo, 0.5Si, 0.3Mn, 0.15C, 0.035P, 0.035S |
| | T5 | S50100 | Bal.Fe:5Cr:0.5Mo, 0.5Si, 0.3Mn, 0.15C, 0.04P, 0.03S |
| | T9 | J82090 | Bal.Fe:9Cr:1.0Si, 0.35Mn, 0.02C, 0.04P, 0.045S |

TABLE 2-continued

| Base Metal R | Alloy | UNS No. | Alloy Compositions (Weight %) |
|---|---|---|---|
| Ferritic stainless steels | 409 | S40900 | Bal.Fe:10.5Cr:1.0Si, 1.0Mn, 0.5Ni, 0.5Ti, 0.08C, 0.045P, 0.045S |
| | 410 | S41000 | Bal.Fe:11.5Cr:0.15C, 0.045P, 0.03S |
| | 430 | S43000 | Bal.Fe:16.0Cr:1.0Si, 1.0Mn, 0.12C, 0.045P, 0.03S |
| Austenetic stainless steels | 304 | S30400 | Bal.Fe:8Ni:18Cr:2.0Mn, 0.75Si, 0.08C, 0.04P, 0.03S |
| | 347 | S34700 | Bal.Fe:12Ni:18Cr:1.0Nb, 0.08C, |
| | 310 | S31000 | Bal.Fe:19Ni:24Cr:2.0Mn, 1.5Si, 0.75Mo, 0.25C, 0.045P, 0.03S |
| | 253MA | S30815 | Bal.Fe:11Ni:21Cr:1.7Si, 0.04Ce, 0.17N, 0.08C |
| | RA85H | S30615 | Bal.Fe:14.5Ni:18.5Cr:3.5Si:1.0Al, 0.2C |
| Duplex stainless steels | 2205 | S32205 | Bal.Fe:4.5Ni:22Cr:2.0Mn, 1.0Si, 3.0Mo, 0.03C, 0.14N, 0.03P, 0.02S |
| | 2507 | S32507 | Bal.Fe:6Ni:24Cr:1.2Mn, 0.8Si, 3.0Mo, 0.5Cu, 0.03C, 0.2N, 0.035P, 0.02S |
| Inconel alloys | Inconel 600 | N06600 | Bal.Ni:8.0Fe:25.5Cr, 0.08 |
| | Inconel 601 | N06601 | Bal.Ni:14.4Fe:23.0Cr:0.3Mn:1.4Al, 0.5Si, 0.1C |
| | Inconel 602CA | N/A | Bal.Ni:9.5Fe:25.0Cr:2.2Al, 0.18C |
| | Inconel 690 | N06690 | Bal.Ni:9.0Fe:29.0Cr:0.3Mn:1.4Al, 0.5Si, 0.1C |
| | Inconel 693 | N06693 | Bal.Ni:4.0Fe:29.0Cr:3.1Al |
| | Inconel MA754 | N/A | Bal.Ni:9.0Fe:29.0Cr:0.3Mn:1.4Al, 0.5Si, 0.1C |
| Incoloy alloys | Incoloy 800H | N08810 | Bal.Fe:33.0Ni:21.0Cr:0.8Mn:0.5Al:0.4Si:0.5Ti:0.07C |
| | Incoloy 803 | S35045 | Bal.Fe:35.0Ni:25.0Cr:0.3Al:0.3Ti:1.0Mn:0.5Si:0.08C |
| | Incoloy 825 | N08825 | Bal.Ni:30.0Fe:21.5Cr:3.0Mo:2.2Cu:0.03C |
| Fe—Ni based alloys | KHR-45A (35/45 Alloy) | N/A | Bal.Fe:43.6Ni:32.1Cr:1.0Mn:1.7Si:0.9Nb:0.1Ti:0.4C |
| Ni-based alloys | Haynes 214 | N07214 | Bal.Ni:3.0Fe:2.0Co:16.0Cr:0.5Mn:4.5Al:0.2Si:0.5Mo:0.5Ti:0.05C |
| Co-based alloys | Haynes 188 | R30188 | Bal.Co:22.0Ni:22.0Cr:3.0Fe:14.0W:0.04La:0.1C |
| | MP35N | R30035 | Bal.Co:35.0Ni:20.0Cr:10.0Mo |

A method for reducing corrosion and fouling of the fired heater tubes exposed to heavy crude oils and resid in refinery process units is also disclosed in the present invention. The method entails providing a metal surface with a high performance coated material composition, wherein the material composition comprises: (PQR), wherein P is an oxide layer at the surface of (PQR), Q is a coating metal layer located between P and R, and R is a base metal layer, wherein P is a mono-layer or made up of multiple layers and substantially comprised of alumina, chromia, silica, mullite, spinels and mixtures thereof and may contain some impurity oxides formed from the element constituting a coating metal Q and a base metal R, Q comprises Cr, and at least one element selected from the group consisting of Ni, Al, Si, Mn, Fe, Co, B, C, N, P, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag, Au and mixtures thereof, and R is selected from the group consisting of low chromium steels, ferritic stainless steels, austenetic stainless steels, duplex stainless steels, Inconel alloys, Incoloy alloys, Fe—Ni based alloys, Ni-based alloys and Co-based alloys.

Metal surfaces to reduce corrosion and fouling of the fired heater tubes exposed to heavy crude oils and resid in refinery process units at temperatures in the range of 600-1500° F. (316-816° C.) may be constructed of the high performance coated material, co-extruded with the coating metal, coated with the coating metal, or a combination of the three. The composition may be formed by constructing the fired heater tube out of a coating metal layer Q and base metal layer R. The composition may be formed by co-extruding a coating metal layer Q and a base metal layer R using steel co-extrusion techniques known to one skilled in the art. Alternatively, the composition may be formed from the existing surfaces of the fired heater tube susceptible to corrosion and fouling that are fabricated from a base metal R by coating the surface with a coating metal Q using coating techniques known to one skilled in the art. Exemplary coating techniques suitable for coating base metals R with the coating metal compositions described herein include, but are not limited to, CVD, MOCVD, PVD, slurry coating, pack cementation, weld overlay, direct metal laser deposition (DMLD), plasma powder welding (PPW), thermal spraying and sputtering. Hence the high performance coated material compositions (PQR) of the present invention may be either constructed of, co-extruded with, or coated with the high performance coated material compositions described herein.

The coating metal Q may alternatively be applied to a base metal R by insertion, expansion and annealing method. The insert made out of the coating metal Q is sized such that the outer diameter of the insert is sized to abut the inner diameter surface of the tube made out of a base metal R. The insert can be retrofitted in existing tubes or fit over a new tube. In either case, the insert is sized to closely surround the tube. The insert may be constructed from any of the materials described herein having the above described coating metal composition Q. It is important that the insert contact the tube such that the heat transfer properties are not adversely or significantly diminished. As is currently the case with installing inserts into fired heater tubes, good metal-to-metal contacting must be insured in order to minimize heat transfer losses that could occur due to air gaps between the outer tube and the tube liner. In all cases, the tube inner diameter must be as clean as possible and free of solids or liquids before the insert is expanded by hydrostatic or pneumatic pressures. Ensuring a clean surface is relatively straight forward for new tubing, but can be more problematic for used tubing. Hydro blasting of the used tube, drying and light mechanical honing may be required. Following hydrostatic expansion of the insert, mechanical rolling of the ends of the inserts is also required to produce a good mechanical seal between the insert and the outer tube. Once good metal-to-metal contacting is achieved by hydrostatic expansion of the insert, the inserted tubes are annealed at high temperatures to make metal-to-metal bonding. The annealing temperature is preferably below the melting points of both the insert and the tube metals. The annealing operation is preferably performed in an inert atmosphere or a reducing atmosphere or under vacuum. For example, the inert atmosphere can be argon and the reducing atmosphere can be hydrogen. Optionally pressure can be applied to the inserted tubes during annealing to further ensure complete metal-to-metal bonding. After annealing the inserted tube body is allowed to cool, typically to ambient conditions.

The protective surface oxide layer P described above may be formed in-situ during operation of the fired heater tubes in heavy crude oil and resid streams. Alternatively, the protective surface oxide layer P described above may be formed prior to use of the fired heater tubes by exposure of the coated metal and base metal combination (QR) to a controlled low oxygen partial pressure environment. Non-limiting examples of a controlled low oxygen partial pressure environment are exposing the high performance coated material of the present invention to a refinery steam, a gaseous $H_2O$:$H_2$ mixture or a gaseous $CO_2$:CO mixture. The controlled low oxygen partial pressure environment may further contain other gases such as $CH_4$, $NH_3$, $N_2$, $O_2$, He, Ar and hydrocarbons. The preferred temperature range is from about 300° C. to about 1000° C., preferably from about 400° C. to about 1000° C. Typical exposure times can range from about 1 hour to about 300 hours, preferably from about 1 hour to about 100 hours. Therefore, the protective oxide coating layer P may be formed during use or prior to use of the alloys under controlled low oxygen partial pressure environments.

The following examples illustrate the present invention and the advantages thereto without limiting the scope thereof.

For commercially available alloys (Kanthal APM and 304SS), square samples of 10 mm×10 mm×1.5 mm were prepared from the alloy sheets. Two coating metals (NiCrMo and NiFeCrAl) were applied to two base metals (T9 ferritic steel and 347 austenitic stainless steel furnace tubes) by a PPW method. The base metals were in a tubular shape in the size of 88.9 mm OD×7.62 mm WT×1 m Length. Table 3 illustrates high performance coated materials and dimension of the sample tubes before and after PPW coating. About 2.4 mm thick coating metals were applied to base metals.

TABLE 3

| | OD (mm) | | ID (mm) | | Wall Thickness (mm) | |
|---|---|---|---|---|---|---|
| Base Metal-Coating Metal | Original | After PPW | Original | After PPW | Original | After PPW |
| T9-NiCrMo | 88.7 | 88.5 | 73.9 | 68.8 | 7.4 | 9.8 |
| T9-NiFeCrAl | 88.7 | 88.5 | 73.9 | 68.7 | 7.4 | 9.9 |
| 347-NiCrMo | 89.3 | 89.0 | 72.6 | 67.4 | 8.4 | 10.8 |
| 347-NiFeCrAl | 89.3 | 89.0 | 72.6 | 67.8 | 8.4 | 10.6 |

For PPW coated tubes (T9 and 347), square samples of 10 mm×10 mm×3.5 mm were prepared from the tube. All of the PPW coating metals were included in the specimen, but most of base metals were cut off to fit them into the lab reactor. The specimen faces having a PPW coating were polished to Linde B (0.05 micrometers alumina powder) finish and cleaned in acetone.

All the samples were exposed to heavy crude resid at 1000° F. (538° C.) for 4 hours in a tubing bomb test apparatus. After testing, the specimen was cleaned in toluene and acetone sequentially and characterized by selected analytical instruments. Both surface and cross sectional images of the tested specimen were examined using Scanning Electron Microscopy (SEM). The atomic percent of elements in the oxide layer and the coating metal is determined by standard Auger Electron Spectroscopy (AES) analysis. A focused electron beam irradiates a specimen surface and produces Auger electrons, whose energies are characteristic of the element from which they are generated. Compositional depth profiling of elements is accomplished by using an independent ion beam to sputter the sample surface while using AES to analyze each successive depth.

EXAMPLES

Example 1

Figure 3:
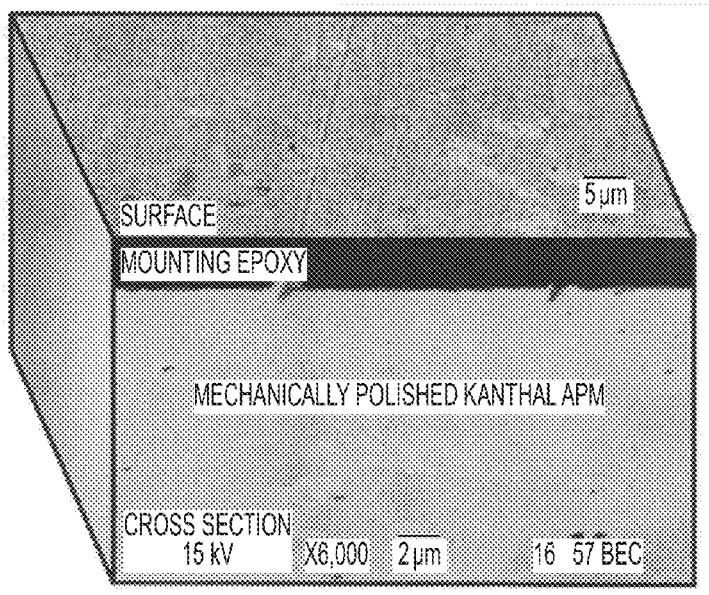
FIG. 3 illustrates a surface and cross-sectional scanning electron microscopy (SEM) images of the corrosion surface of a mechanically polished sample after reaction at 1000° F. (538° C.) in a heavy resid-content crude for 4 hours.
Figure 4:
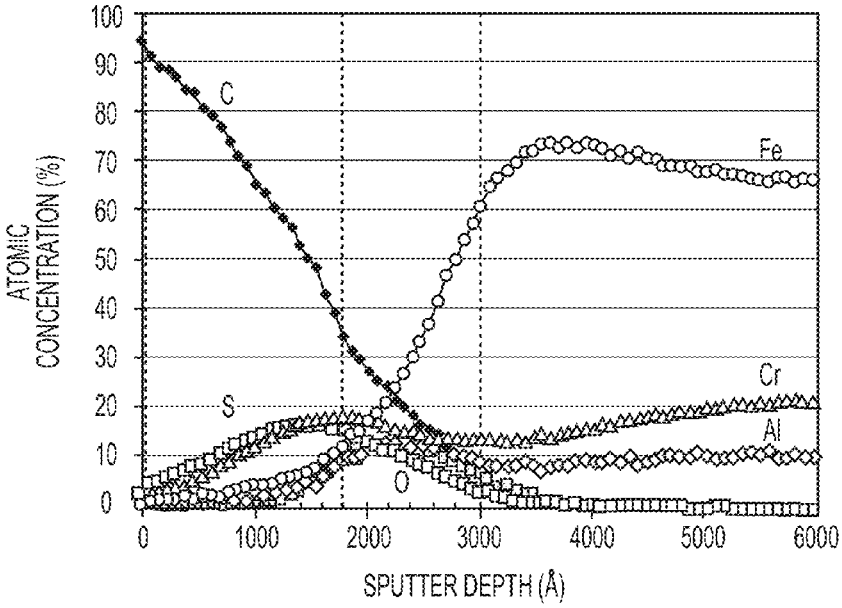
FIG. 4 illustrates an AES concentration depth profile of the corrosion surface of a mechanically polished sample of FIG. 3 after reaction at 1000° F. (538° C.) in a heavy resid-content crude for 4 hours.

Following the test methods described above, a mechanically polished Kanthal APM sample was tested. FIG. 3 depicts surface and cross-sectional SEM images of the corrosion surface of a mechanically polished Kanthal APM after reaction at 1000° F. (538° C.) in heavy resid-content crude for 4 hours. No significant corrosion or fouling deposits were observed after the specimen was cleaned in toluene and acetone sequentially. FIG. 4 depicts AES concentration depth profile of the corrosion surface of the same sample. The carbon peak found near the surface was probably caused by remnants of crude deposits. Also identified was about 200 nm thick corrosion scale, which was mainly comprised of Cr—Fe sulfide and Cr—Al oxide. Under this layer, about 200 nm thick alumina sublayer formation was observed. This alumina layer provides superior corrosion resistance of the coating metal, which is prerequisite for fouling mitigation.

Example 2

Figure 5:
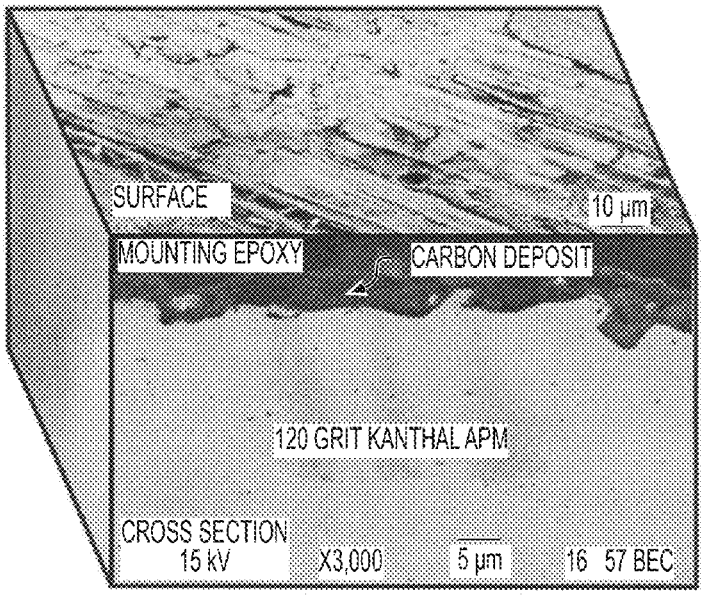
FIG. 5 illustrates the surface and cross-sectional scanning electron microscopy (SEM) images of the corrosion surface of an 120 grit finished sample after reaction at 1000° F. (538° C.) in a heavy resid-content crude for 4 hours.

Following the test methods described above, a 120 grit finished Kanthal APM sample was tested. FIG. 5 depicts surface and cross-sectional SEM images of the corrosion surface of a 120 grit finished Kanthal APM after reaction at 1000° F. (538° C.) in heavy resid-content crude for 4 hours. After cleaned the specimen in in toluene and acetone sequentially, no significant corrosion scale was observed. However, some thin layer of carbon deposit was observed on the surface, whose deposit appeared to be anchored to the roughened surface of the metal. Superior corrosion resistance was attributed to alumina layer formed on the metal surface. The thickness of alumina layer was about 200 nm measured by AES.

The cross-section SEM images illustrated in FIGS. 3 and 5 illustrate the effect of surface roughness in reduction of carbon deposit. Two samples were tested and cleaned at the same experimental conditions. The thickness of the carbon deposit on the rough surface (e.g. 120 grit finish) was about 4 microns and uniformly present on the surface. The average surface roughness (Ra) of the 120 grit finish surface measured by a skidded contact profilometer was about 80 micro inches (2.2 μm). By contrast, no carbon deposit was found on the smooth surface (e.g. mechanically polished). The average surface roughness (Ra) of the mechanically polished surface measured by a skidded contact profilometer was about 40 micro inches (1.1 μm). The metal surface having the reduced surface roughness exhibited less fouling. Both surfaces revealed good corrosion resistance as confirmed by a protective alumina layer formed in-situ during testing. The reduction in carbon deposit, shown in FIGS. 3 and 5 illustrate the additional benefit of the surface smoothness.

Example 3

Comparative Example

Figure 6:
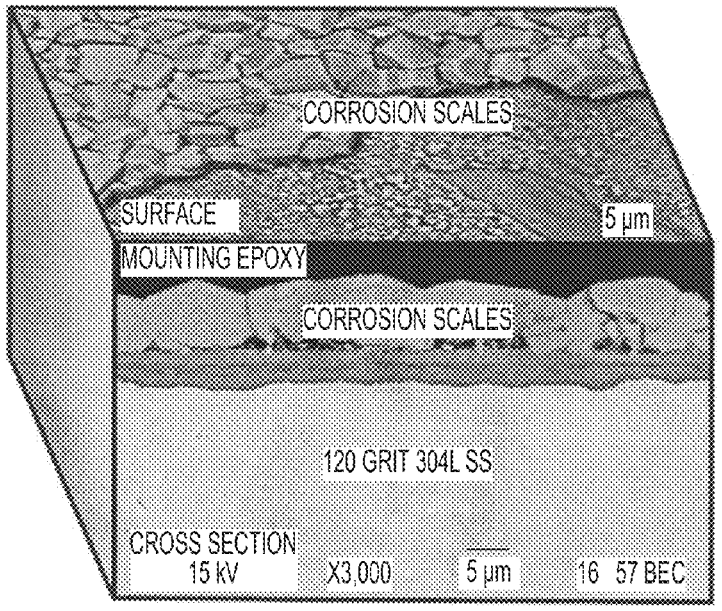
FIG. 6 illustrates surface and cross-sectional scanning electron microscopy (SEM) images of the corrosion surface of a 120 grit finished 304L stainless steel (comparative example) after reaction at 1000° F. (538° C.) in a heavy resid-content crude for 4 hours.

Following the test methods described above, a 120 grit finished 304L SS sample was tested. FIG. 6 depicts surface and cross-sectional SEM images of the corrosion surface of a 120 grit finished 304L SS after reaction at 1000° F. (538° C.) in heavy resid-content crude for 4 hours. Formation of thick (about 8μ) multi-layered corrosion scale was observed. Corrosion scales were comprised of Fe sulfide, Fe—Cr sulfide, thiospinel and Fe—Cr oxysulfide based on Energy Dispersive X-ray Spectroscopy (EDXS) characterization. In comparison with the same surface finished Kanthal APM (Example 2), the thickness of corrosion scale on 304L SS was about 40 times thicker (8000 nm vs. 200 nm). This result clearly confirms that the alumina layer formed on Knathal APM surface is much more resistant to corrosion than the corrosion scales formed on 304L SS surface.

Example 4

NiFeCrAl-4 on 347 Stainless Steel

A coating metal (NiFeCrAl-4 in Table 1, Ba1.Ni:19.9Cr:5.2Al:38.6Fe:0.3Si) was formed on a 347 stainless steel base metal surface by a PPW method. The tubular base metal had a size of 95.25 mm OD×5.72 mm WT×1 m length. About 2.4 mm thick coating metal was applied to a base metal and machined to about 1.5 mm thickness with the average surface roughness of about 40 micro inches. By use of the PPW coated tube, a square specimen of 10 mm×10 mm×3.5 mm was prepared from the tube. The whole thickness of the PPW coating metal was included in the specimen, but most of the base metal was cut off to fit into a lab reactor. Following the test method described above, the NiFeCrAl-4 coated 347SS specimen was tested at 1056 F (560 C) for 20 hours in a heavy resid medium. No corrosion was observed on the NiFeCrAl-4 coating metal surface after the specimen was retrieved from a reactor. About 100 nm thick protective oxide (alumina) layer was identified on the surface of the PPW coating metal. This alumina layer provided superior corrosion resistance.

Example 5

NiFeCrAl-5 on 347 Stainless Steel

A coating metal (NiFeCrAl-5 in Table 1, Ba1.Ni:21.6Cr:5.5Al:34.9Fe:0.3Si) was formed a 347 stainless steel base metal surface by a PPW method. The tubular base metal had a size of 95.25 mm OD×5.72 mm WT×10 cm length. About 2.4 mm thick coating metal was applied to a base metal and machined to about 1.5 mm thickness with the average surface roughness of about 40 micro inches. Following the test method described above, the NiFeCrAl-5 coated 347SS specimen was tested at 1056 F (560 C) for 20 hours in a heavy resid medium. No corrosion was observed on the NiFeCrAl-5 coating metal surface after the specimen was retrieved from a reactor. About 100 nm thick protective oxide (alumina) layer was identified on the surface of the PPW coating metal. This alumina layer provided superior corrosion resistance.

Example 6

NiFeCr on 347 Stainless Steel

A coating metal (NiFeCr in Table 1, Ba1.Ni:44.6Cr:8.9Fe:0.3Si) was formed on a 347 stainless steel base metal surface by a PPW method. The tubular base metal had a size of 95.25 mm OD×5.72 mm WT×10 cm length. About 2.4 mm thick coating metal was applied to a base metal and machined to about 1.5 mm thickness with the average surface roughness of about 40 micro inches. Following the test method described above, the NiFeCr coated 347SS specimen was tested at 1056 F (560 C) for 20 hours in a heavy resid medium. No corrosion was observed on the NiFrCr coating metal surface after the specimen was retrieved from the reactor. About 300 nm thick protective oxide (chromia) layer was identified on the surface of the PPW coating metal. This chromia layer provided superior corrosion resistance.

The present invention relates to a high performance coated material capable of forming a stable oxide surface film. The coating metal of the present invention yields improved adhesion of the surface oxide film or layer, which enhances spalling resistance, improved adhesion of the base metal, which improves the coating integrity, stability and durability and reduced corrosion and fouling of the fired heater tubes exposed to heavy crude oils and resid in refinery process units with respect to the prior art. The high performance coated material composition of the present invention offers significant advantages relative to prior art alloy compositions for use as protective coatings to corrosion and fouling on metal surfaces exposed to crude oils and resid streams in refinery process units. The advantageous properties and/or characteristics of the disclosed high performance coated alloy compositions are based, at least in part, on the structure of the oxide film formed on the surface of the coating metal, which include, inter alia, improved corrosion resistance, decreased fouling, decreased coke deposition, increased coke spalling on fired heater tubes used in refinery process units, improved adhesion of in-situ formed surface oxide films, improved oxide film spalling resistance, improved ease of oxide formation prior to and in use. The advantageous properties and/or characteristics of the disclosed high performance coated alloy compositions are based, at least in part, on the structure of the coating metal formed on the surface of the base metal, which include, inter alia, increased coating thickness, improved adhesion to the base metal, improved coating metal integrity, stability and durability when exposed to crude oils and resid streams in refinery process units.

It will be apparent to those skilled in the art that various modifications and/or variations may be made without departing from the scope of the present invention. Thus, it is intended that the present invention covers the modifications and variations of the apparatus and methods herein, provided they come within the scope of the appended claims and their equivalents.

What is claimed is:

1. A fired heater tube with enhanced resistance to corrosion and fouling for use in a process unit in which heavy crude or a resid stream is heated for processing, comprising:

a tube having an inner surface and an outer surface, the tube comprising:

a base metal layer selected from T9 low chromium steel or 347 austenitic stainless steel;

a coating metal layer on the base metal layer applied by plasma powder welding and having an average surface roughness (Ra) of less than 40 micro inches (1.1 μm) located on the base metal layer on at least one of the inner surface and the outer surface, the coating metal layer comprising an alloy of 3 wt. % to 10 wt. % aluminum, 15 wt. % to 25 wt. % chromium, and 5 to 40 wt. % iron, carbon in an amount less than 0.1 wt. %, less than 0.8 wt. % silicon with the balance being Ni; and an oxide layer having a thickness of between 1 nm and 100 μm on the coating metal layer, wherein the oxide layer is substantially comprised of alumina, chromia, silica, mullite, spinels, or mixtures thereof, wherein the coating metal layer is between the base metal layer and the oxide layer.

2. The fired heater tube of claim 1, wherein the oxide layer is alumina.

3. The fired heater tube according to claim 1, wherein the coating metal layer comprises about 0.01 wt. % to about 2.0 wt. % of oxide particles of at least one element selected from Al, Si, Sc, La, Y and Ce.

4. The fired heater tube of claim 1, wherein the coating metal layer has a thickness between from about 0.5 mm to about 4 mm.

5. The fired heater tube of claim 1, wherein the coating metal layer has a porosity of less than about 3 volume percent.

6. The fired heater tube according to claim 1 in which the coating metal layer comprises an oxide dispersion strengthened (ODS) alloy comprising 0.01 wt. % to 2.0 wt. % of oxide particles of at least one element selected from Al, Si, Sc, La, Y and Ce.

* * * * *